United States Patent [19]

Johnson et al.

[11] Patent Number: 4,719,007

[45] Date of Patent: Jan. 12, 1988

[54] PROCESS FOR HYDROTREATING A HYDROCARBONACEOUS CHARGE STOCK

[75] Inventors: Russell W. Johnson, Elmhurst; Walter F. Hribik, La Grange Park; Lee Hilfman, Mount Prospect, all of Ill.

[73] Assignee: UOP Inc., Des Plaines, Ill.

[21] Appl. No.: 924,953

[22] Filed: Oct. 30, 1986

[51] Int. Cl.[4] ..... C10G 67/06; C10G 67/10

[52] U.S. Cl. ..... 208/251 H; 208/99; 208/144; 208/177; 208/251 R; 208/262; 208/301; 208/310 R; 502/22; 502/25; 502/515; 502/516

[58] Field of Search ..... 208/262, 299, 301, 302, 208/303, 305, 144, 99, 97, 81, 83, 251 R, 251 H, 177, 310 R; 585/820, 826, 841; 502/22, 25, 514, 515, 516

[56] References Cited

U.S. PATENT DOCUMENTS

| | | | |
|---|---|---|---|
| 2,908,639 | 10/1959 | Carter et al. | 208/305 |
| 2,944,012 | 7/1960 | Thompson | 208/301 |
| 3,024,203 | 3/1962 | Strecker | 208/305 |
| 3,055,823 | 9/1962 | Mason et al. | 208/301 |
| 3,121,678 | 2/1964 | Behymer et al. | 208/144 |
| 3,501,396 | 3/1970 | Gatsis | 208/216 |
| 3,547,806 | 12/1970 | Matyear | 208/262 |
| 3,892,818 | 7/1975 | Scharfe et al. | 260/676 R |
| 3,898,153 | 8/1975 | Louder et al. | 208/262 |
| 3,919,398 | 11/1975 | Davis | 423/481 |
| 3,925,193 | 12/1975 | Constantikes et al. | 208/262 |
| 3,935,295 | 1/1976 | La Hue et al. | 208/262 |
| 4,447,315 | 5/1984 | Lamb et al. | 208/99 |

*Primary Examiner*—Curtis R. Davis
*Assistant Examiner*—Anthony McFarland
*Attorney, Agent, or Firm*—Thomas K. McBride; John F. Spears, Jr.; John G. Cutts, Jr.

[57] ABSTRACT

A process for hydrotreating a hydrocarbonaceous charge stock having hydrogenatable hydrocarbonaceous compounds which process comprises the steps of: (a) contacting said hydrocarbonaceous charge stock in the presence of hydrogen with a hydrogenation catalyst in a hydrotreating reaction zone; (b) contacting said hydrotreating reaction zone effluent with an aqueous scrubbing solution; (c) introducing a resulting admixture of said reaction zone effluent and said aqueous scrubbing solution into a separation zone to provide a hydrotreated hydrocarbonaceous stream having trace quantities of hydrogenatable hydrocarbonaceous compounds and a spent aqueous stream; and (d) contacting said hydrotreated hydrocarbonaceous stream with an adsorbent to remove at least a portion of said trace quantities of hydrogenatable hydrocarbonaceous compounds from said hydrotreated hydrocarbonaceous stream.

16 Claims, 1 Drawing Figure

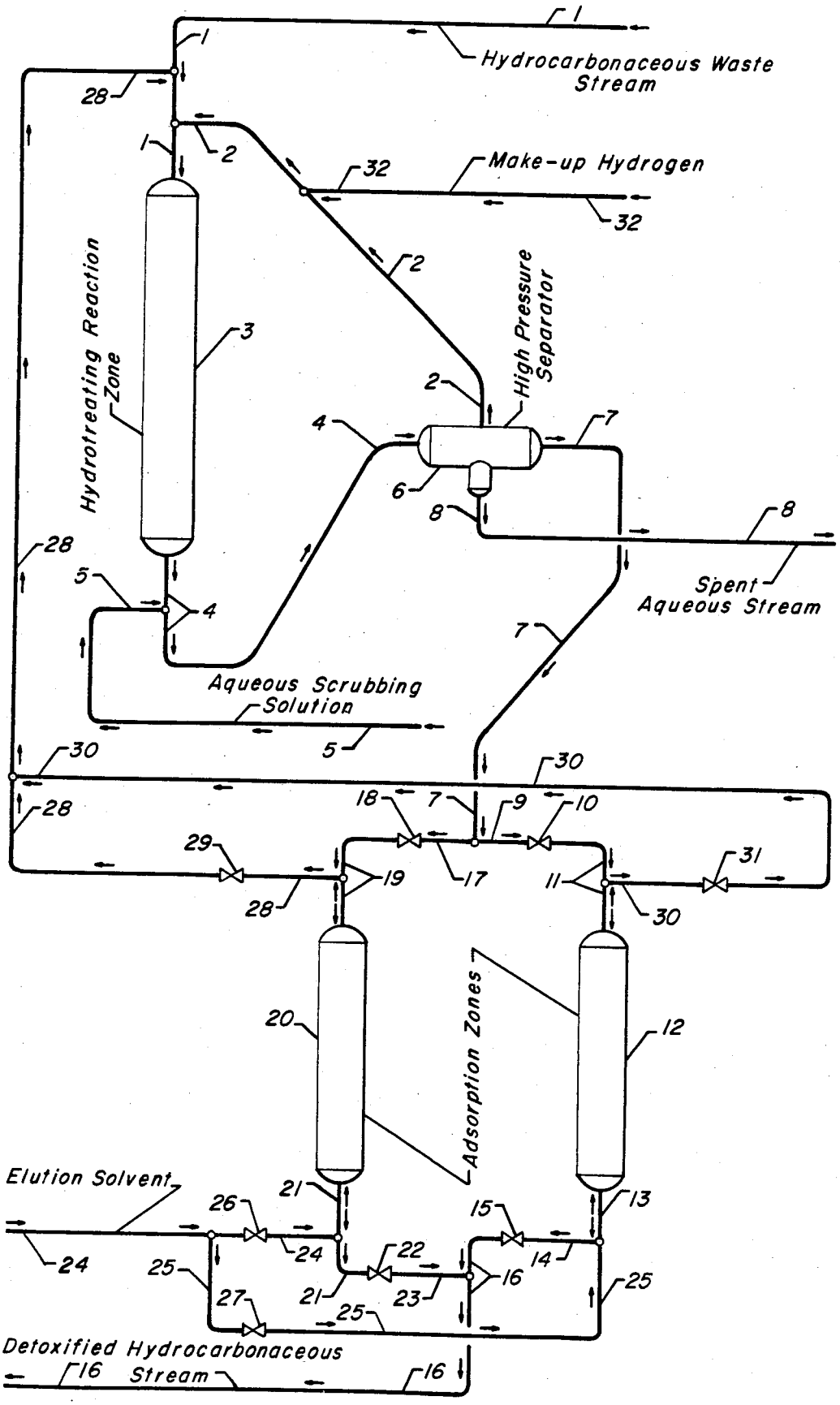
Hydrocarbonaceous Waste Stream
Make-up Hydrogen
Hydrotreating Reaction Zone
High Pressure Separator
Spent Aqueous Stream
Aqueous Scrubbing Solution
Adsorption Zones
Elution Solvent
Detoxified Hydrocarbonaceous Stream

PROCESS FOR HYDROTREATING A HYDROCARBONACEOUS CHARGE STOCK

BACKGROUND OF THE INVENTION

The field of art to which this invention pertains is the hydrotreating of a hydrocarbonaceous charge stock. More particularly, the invention relates to hydrotreating hydrocarbons containing hazardous or obnoxious hydrocarbonaceous compounds. More specifically, the invention relates to a process for hydrotreating a hydrocarbonaceous charge stock having hydrogenatable hydrocarbonaceous compounds which process comprises the steps of: (a) contacting said hydrocarbonaceous charge stock in the presence of hydrogen with a hydrogenation catalyst in a hydrotreating reaction zone; (b) contacting said hydrotreating reaction zone effluent with an aqueous scrubbing solution; (c) introducing a resulting admixture of said reaction zone effluent and said aqueous scrubbing solution into a separation zone to provide a hydrotreated hydrocarbonaceous stream having trace quantities of hydrogenatable hydrocarbonaceous compounds and a spent aqueous stream; and (d) contacting said hydrotreated hydrocarbonaceous stream with an adsorbent to remove at least a portion of said trace quantities of hydrogenatable hydrocarbonaceous compounds from said hydrotreated hydrocarbonaceous stream.

INFORMATION DISCLOSURE

In U.S. Pat. No. 3,919,398 (Davis), a method is disclosed for recovering bromine as hydrogen bromide from aromatic bromides. The method involves reacting the aromatic bromide with hydrogen at a temperature within the range from about 200° to about 600° C. in the presence of a palladium activated catalyst.

In U.S. Pat. No. 3,892,818 (Scharfe et al.), a method is disclosed for the conversion of hydrocarbon chlorides in the presence of hydrogen to hydrocarbons and hydrogen chloride wherein the process takes place in a gaseous phase and in the presence of rhodium-containing catalyst.

In U.S. Pat. No. 3,501,396 (Gatsis), a method is disclosed for desulfurizing an asphaltene-containing black oil in admixture with 2 to 30% by weight of water in contact with an acidic catalyst containing molybdenum and nickel.

It is well known in the petroleum industry that water is injected into the effluent of hydrotreating reaction zones to prevent the accumulation and eventual plugging of the heat exchange circuit and piping with salts which are produced in the hydrotreating reaction zone. The adsorption of contaminants from aqueous streams is also well known.

BRIEF SUMMARY OF THE INVENTION

The invention provides a process for hydrotreating a hydrocarbonaceous charge stock having hydrogenatable hydrocarbonaceous compounds by contacting the charge stock in the presence of hydrogen with a hydrogenation catalyst in a hydrotreating reaction zone and contacting the resulting hydrotreated hydrocarbonaceous stream having trace quantities of hydrogenatable hydrocarbonaceous compounds with an adsorbent to remove at least a portion of the trace quantities of hydrogenatable hydrocarbonaceous compounds from the hydrotreated hydrocarbonaceous stream. The present invention also contemplates the recovery of the hydrogenatable hydrocarbonaceous compounds from the adsorbent by contacting the adsorbent with an elution solvent to remove the hydrocarbonaceous compounds and passing the elution solvent containing the recovered hydrogenatable hydrocarbonaceous compounds into the hydrotreating reaction zone.

One broad embodiment of the invention may be characterized as a process for hydrotreating a hydrocarbonaceous charge stock having hydrogenatable hydrocarbonaceous compounds which process comprises the steps of: (a) contacting the hydrocarbonaceous charge stock in the presence of hydrogen with a hydrogenation catalyst in a hydrotreating reaction zone; (b) contacting the hydrotreating reaction zone effluent with an aqueous scrubbing solution; (c) introducing a resulting admixture of the reaction zone effluent and the aqueous scrubbing solution into a separation zone to provide a hydrotreated hydrocarbonaceous stream having trace quantities of hydrogenatable hydrocarbonaceous compounds and a spent aqueous stream; and (d) contacting the hydrotreated hydrocarbonaceous stream with an adsorbent to remove at least a portion of the trace quantities of hydrogenatable hydrocarbonaceous compounds from the hydrotreated hydrocarbonaceous stream.

Another embodiment of the invention may be characterized as a process for hydrotreating a hydrocarbonaceous charge stock having hydrogenatable hydrocarbonaceous compounds which process comprises the steps of: (a) contacting the hydrocarbonaceous charge stock in the presence of hydrogen with a hydrogenation catalyst in a hydrotreating reaction zone; (b) contacting the reaction zone effluent with an aqueous scrubbing solution; (c) introducing a resulting admixture of the reaction zone effluent and the aqueous scrubbing solution into a separation zone to provide a hydrotreated hydrocarbonaceous stream having trace quantities of hydrogenatable hydrocarbonaceous compounds and a spent aqueous stream; (d) contacting the hydrotreated hydrocarbonaceous stream with an adsorbent to remove at least a portion of the trace quantities of hydrogenatable hydrocarbonaceous compounds from the hydrotreated hydrocarbonaceous stream; (e) removing the hydrogenatable hydrocarbonaceous compounds from spent adsorbent with an elution solvent and thereby regenerating the adsorbent; and (f) passing the elution solvent containing hydrogenatable hydrocarbonaceous compounds which were removed from the spent adsorbent in step (e) into the hydrotreating reaction zone of step (a).

Yet another embodiment of the invention may be characterized as a process for regenerating a spent adsorbent which contains hydrogenatable hydrocarbonaceous compounds which process comprises the steps of: (a) removing the hydrogenatable hydrocarbonaceous compounds from the spent adsorbent with an elution solvent and thereby regenerating the adsorbent; and (b) passing the elution solvent containing hydrogenatable hydrocarbonaceous compounds which were removed from the spent adsorbent in step (a) into a hydrotreating reaction zone.

Other embodiments of the subject invention encompass further details such as hydrocarbonaceous charge stocks, dehydrogenatable hydrocarbonaceous compounds, aqueous scrubbing solutions, hydrotreating catalysts, adsorbents, elution solvents and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of reducing or eliminating the environmental discharge of trace quantities of hydrogenatable hydrocarbonaceous compounds. An even greater demand is foreseen when these hydrogenatable hydrocarbonaceous compounds are toxic, carcinogenic or otherwise obnoxious. Conventional hydrocarbon hydrotreating units may have trace quantities of dehydrogenatable hydrocarbonaceous compounds in the hydrotreated hydrocarbonaceous stream and the removal of these compounds, particularly if they are obnoxious, is highly desirable before the hydrotreated hydrocarbonaceous stream is subsequently used. In the event that those trace dehydrogenatable hydrocarbonaceous compounds are exceedingly obnoxious, it is preferred that the hydrocarbonaceous compounds not only be removed from the hydrotreated hydrocarbonaceous stream but converted into less noxious compounds. Therefore, those skilled in the art have sought to find feasible and convenient techniques to remove trace amounts of hydrogenatable hydrocarbonaceous compounds from the hydrotreated hydrocarbonaceous stream emanating from a hydrotreating process unit and to subsequently provide for the suitable disposal of the recovered hydrogenatable hydrocarbonaceous compounds. The present invention provides an improved hydrotreating process whereby the trace quantities of hydrogenatable hydrocarbonaceous compounds are removed from the hydrotreated hydrocarbonaceous stream.

The hydrocarbonaceous charge stock which may suitably be hydrotreated in the process of the present invention includes naphtha, kerosene, middle distillate, diesel fuel, gas oil, vacuum gas oil and reduced crude which are produced by the fractionation of petroleum crude oil. In general, suitable hydrocarbonaceous charge stocks are those stocks which derive improvement in quality when subjected to hydrotreating. Traditionally, hydrotreating has been utilized to remove sulfur, nitrogen and other contaminants from hydrocarbonaceous compounds. Suitable hydrocarbonaceous charge stocks also include hydrocarbons derived from tar sand, oil shale and coal, and may comprise sulfur, oxygen, metal or nitrogen components. A preferred class of charge stocks include halogenated hydrocarbons. Certain halogenated hydrocarbons having demonstrated or potential toxicity include but are not limited to kepone, halogenated biphenyls, halogenated cyclodienes, such as aldrin, dieldrin, and hexachlorocyclopentadienes, dibromochloropropane, halogenated phthalic anhydrides, such as polybromophthalicanhydride, tetrachloroethylene, polychlorodioxins such as tetrachlorodibenzodioxin, halogenated organic phosphates such as 2,2 dichlorovinydimethyl phosphate. Additional examples of hydrocarbonaceous compounds include organometallic compounds and especially those which contain metals such as lead, mercury, cadmium, cobalt, arsenic, vanadium and chromium. In the event that the primary hydrocarbonaceous charge stock is relatively small, it may be desirable to admix the primary charge stock with a suitable solvent or carrier hydrocarbon such as kerosene or diesel fuel, for example, before the introduction of the charge stock into the hydrotreating reaction zone.

In accordance with the subject invention, the hydrocarbonaceous charge stock is introduced into a hydrotreating or hydrogenation zone and is contacted with a hydrogen-rich gaseous phase and a hydrogenation catalyst. The catalytic hydrogenation zone may contain a fixed, ebullated or fluidized catalyst bed. This reaction zone is preferably maintained under an imposed pressure from about 100 psig (2068 k Pa gauge) to about 2000 psig (13790 k Pa gauge) and more preferably under a pressure from about 200 psig (1379 k Pa gauge) to about 1800 psig (12411 k Pa gauge). Suitably, such reaction is conducted with a maximum catalyst bed temperature in the range of about 350° F. (177° C.) to about 850° F. (454° C.) selected to perform the desired hydrogenation conversion to reduce or eliminate the undesirable characteristics or components of the hydrocarbonaceous charge stock. Further preferred operating conditions include liquid hourly space velocities in the range from about 0.2 $hr^{-1}$ to about 10 $hr^{-1}$ and hydrogen circulation rates from about 200 standard cubic feet per barrel (SCFB) (35.6 $m^3/m^3$) to about 10,000 SCFB (1778 $m^3/m^3$), preferably from about 300 SCFB (53.3 $m^3/m^3$) to about 8000 SCFB (1422 $m^3/m^3$).

The preferred catalytic composite disposed within the hereinabove described hydrogenation zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier materials are alumina, silica and mixtures thereof. Suitable metallic components having hydrogenation activity are those selected from the group comprising the metals of Groups VI-B and VIII of the Periodic Table, as set forth in the Periodic Table of the Elements, E. H. Sargent and Company, 1964. Thus, the catalytic composites may comprise one or more metallic components from the group of molybdenum, tungsten, chromium, iron, cobalt, nickel, platinum, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrotreating middle distillate hydrocarbonaceous compounds to remove nitrogen and sulfur should normally function effectively in the hydrogenation zone of the present invention.

The hydrocarbonaceous effluent from the hydrogenation zone is contacted with an aqueous scrubbing solution and the admixture is admitted to a separation zone in order to separate a spent aqueous stream, a hydrogenated hydrocarbonaceous phase having trace quantities of hydrogenatable hydrocarbonaceous compounds and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 40 volume percent based on the hydrocarbonaceous effluent from the hydrogenation zone. The aqueous scrubbing solution is selected depending on the characteristics of the hydrocarbonaceous charge stock. For example, if the hydrocarbonaceous charge stock comprises halogenated compounds, the aqueous scrubbing solution preferably contains a basic compound such as calcium hydroxide, potassium hydroxide or sodium hydroxide in order to neutralize the acid which is formed during the hydrogenation of the halogen compounds. In the event that the hydrocarbonaceous charge stock contains only sulfur and nitrogen compounds, pure water is a suitable aqueous scrubbing solution. The resulting hydrotreated hydrocarbonaceous phase having trace quantities of hydrogenatable hydrocarbonaceous compounds is recovered and the hydrogen-rich gaseous phase may be recycled to the hydrogenation zone if desired.

In accordance with the subject invention, at least a portion of the hydrotreated hydrocarbonaceous phase containing trace quantities of hydrogenatable hydrocarbons which is recovered from a separation zone is contacted with a suitable adsorbent which selectively retains at least a portion of the trace hydrogenatable hydrocarbonaceous compounds and produces a hydrotreated hydrocarbonaceous stream with a reduced concentration of hydrogenatable hydrocarbonaceous compounds. Suitable adsorbents may be selected from materials which exhibit the primary requirement of selectivity towards hydrogenatable hydrocarbonaceous compounds and which are otherwise convenient to use. Suitable adsorbents include, for example, molecular sieves, amorphous silica-alumina gel, silica gel, activated carbon, activated alumina and clays. Of course, it is recognized that for a given case, a particular adsorbent may give better results than others.

The selected adsorbent is contacted with the hydrotreated hydrocarbonaceous stream containing trace quantities of hydrogenatable hydrocarbonaceous compounds in an adsorption zone. The adsorbent may be installed in the adsorption zone in any suitable manner. A preferred method for the installation of the adsorbent is in a fixed bed arrangement. The adsorbent may be installed in one or more vessels and in either series or parallel flow. The flow of the hydrotreated hydrocarbonaceous stream through the adsorption zone is preferably performed in a parallel manner so that when one of the adsorbent beds or chambers is spent by the accumulation of hydrogenatable hydrocarbonaceous compounds thereon, the spent zone may be bypassed while continuing uninterrupted operation through the parallel zone. The spent zone of adsorbent may then be regenerated or the spent adsorbent may be replaced as desired.

In a preferred embodiment of the subject invention, the spent zone of adsorbent is regenerated by isolating the spent adsorption zone and contacting the adsorbent with an elution solvent to remove the hydrogenatable hydrocarbonaceous compounds thereby regenerating the adsorbent. Then the elution solvent containing the hydrogenatable hydrocarbonaceous compounds is introduced into the hydrogenation zone in order to recover and hydrotreat the hydrogenatable hydrocarbonaceous compounds. In general, an elution solvent is utilized which possesses a high solvent selectivity towards the hydrogenatable hydrocarbonaceous compounds adsorbed on the adsorbent and which has no deleterious effect on the adsorbent. Preferred elution solvents are high temperature water or steam. However, any elution solvent which effectively satisfies the above mentioned criterion may be used.

During adsorption, the adsorption zone is preferably maintained at a pressure from about 10 psig (69 k Pa gauge) to about 1500 psig (10342 k Pa gauge), a temperature from about 32° F. (0° C.) to about 300° F. (149° C.) and a liquid hourly space velocity from about 0.1 $hr^{-1}$ to about 500 $hr^{-1}$. The flow of the hydrotreated hydrocarbonaceous stream containing trace quantities of hydrogenatable hydrocarbonaceous compounds through the adsorption zone may be conducted in an upflow, downflow or radial flow manner. The temperature and pressure of the adsorption zone are preferably selected to maintain the hydrotreated hydrocarbonaceous stream in the liquid phase.

During regeneration of the adsorbent, the adsorption zone is preferably maintained at a pressure from about 5 psig (35 k Pa gauge) to about 1500 psig (10342 k Pa gauge), and a temperature from about 32° F. (0° C.) to about 300° F. (149° C.). The flow of the elution solvent through the adsorption zone during regeneration thereof may be conducted in an upflow, downflow or radial flow manner. The elution solvent during the regeneration of adsorbent may be present in a gas phase, a liquid phase or a mixture thereof.

In a preferred embodiment of the subject invention, the admixture of elution solvent and the hydrogenatable hydrocarbonaceous compounds which are removed from the adsorbent during regeneration thereof is introduced into the hydrotreating reaction zone. This embodiment is particularly advantageous in the case where the recovered hydrogenatable hydrocarbonaceous compounds from the adsorbent are toxic, carcinogenic or otherwise obnoxious and are thereby in need of safe and appropriate disposal. The admixture of elution solvent and recovered hydrogenatable hydrocarbonaceous compounds may be admixed with the fresh charge and introduced into the hydrotreating reaction zone, or may be directly charged to the hydrotreating reaction zone.

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

With reference now to the drawing, a hydrocarbonaceous waste stream is introduced into the process via conduit 1 and subsequently passed to hydrotreating reaction zone 3. A hydrogen-rich gaseous stream which is derived in a manner hereinafter described is introduced via conduits 2 and 1 into hydrotreating reaction zone 3. The hydrocarbonaceous waste stream is hydrogenated in hydrotreating reaction zone 3 in the presence of a hydrogenation catalyst maintained at hydrogenation conditions as described hereinabove. The resulting hydrotreated hydrocarbonaceous waste stream having trace quantities of hydrogenatable hydrocarbonaceous compounds and a gaseous phase are removed from hydrotreating reaction zone 3 via conduit 4 and contacted after cooling with an aqueous scrubbing solution introduced via conduit 5. The resulting mixture is introduced via conduit 4 into high pressure separator 6. A hydrogen-rich gaseous phase is removed from high pressure separator 6 via conduit 2 and recycled as described hereinabove. Make-up hydrogen is introduced via conduit 32, conduit 2 and conduit 1 into hydrotreating reaction zone 3. A spent aqueous scrubbing solution is removed from high pressure separator 6 via conduit 8 and recovered. A hydrotreated hydrocarbonaceous stream containing trace quantities of hydrogenatable hydrocarbonaceous compounds is removed from high pressure separator 6 via conduit 7 and is introduced into adsorption zone 12 via conduit 9, valve 10 and conduit 11. Alternatively, the hydrotreated hydrocarbonaceous stream is introduced into adsorption zone 20 which is located in parallel with adsorption zone 12 via conduit 17, valve 18, and conduit 19. A detoxified hydrotreated hydrocarbonaceous stream having a reduced concentration of hydrogenatable hydrocarbonaceous compounds is removed from adsorption zone 12 via conduit 13, conduit 14, valve 15, conduit 16 and recovered. In the alternative, a detoxified hydrotreated hydrocarbonaceous stream having a reduced concentration of hydrogenatable hydrocarbonaceous compounds is removed from adsorption zone 20 via conduit 21, valve 22, conduit 23, conduit 16 and recovered. In the event adsorption zone 20 is to be regenerated, valves 18 and 22 are closed for isolation and an elution solvent is introduced via conduit 24, valve 26, conduit 24, and conduit 21 into adsorption zone 20. An elution solvent rich in hydrogenatable hydrocarbonaceous compounds which have been extracted from adsorption zone 20 is removed via conduit 19, conduit 28, valve 29 and conduit 1 and is introduced into hydrotreating reaction zone 3. In the event that adsorption zone 12 is to be regenerated, valves 10 and 15 are closed for isolation and an elution solvent is introduced via conduit 24, conduit 25, valve 27 and conduit 13 into adsorption zone 12. An elution solvent rich in hydrogenatable hydrocarbonaceous compounds is removed from adsorption zone 12 via conduit 11, conduit 30, valve 31, conduit 30, conduit 28, conduit 1 and introduced into hydrotreating reaction zone 3.

The process of the present invention is further demonstrated by the following illustrative embodiment. This illustrative embodiment is however not presented to unduly limit the process of this invention, but to further illustrate the advantages of the hereinabove described embodiments. The following data were not obtained by the actual performance of the present invention, but are considered prospective and reasonably illustrative of the expected performance of the invention.

ILLUSTRATIVE EMBODIMENT

This illustrative embodiment describes the hydrotreating of a hydrocarbonaceous waste stream comprising about 90 weight percent heavy naphtha and about 10 weight percent polychlorinated biphenyl (PCB). PCB has been used commercially as a heat exchange medium in electrical transformers and has posed formidable disposal problems because of its carcinogenicity and resistance to bio- and photo-degradation in the environment. The conversion or destruction of PCB contained in hydrocarbonaceous waste streams to produce innocuous hydrocarbonaceous compounds is highly desirable.

The hereinabove described hydrocarbonaceous waste stream is introduced together with a gaseous hydrogen-rich stream into a hydrotreating reaction zone loaded with a catalyst comprising alumina, cobalt and molybdenum. The hydrotreating reaction is conducted with a catalyst peak temperature of 750° F. (399° C.), a pressure of 900 psig (6205 k Pa gauge), a liquid hourly space velocity of 1 based on fresh feed and a hydrogen circulation rate of 2500 SCFB (444 std $m^3/m^3$). The hydrotreated effluent from the hydrotreating reaction zone is cooled to about 100° F. (38° C.), contacted co-currently with an aqueous scrubbing solution containing sodium hydroxide in an amount of 10 volume percent based on the hydrocarbonaceous effluent from the hydrotreating zone and sent to a vapor-liquid high pressure separator wherein a gaseous hydrogen-rich stream is separated from the normally liquid hydrocarbonaceous products and spent aqueous scrubbing solution. The resulting gaseous hydrogen-rich stream is then recycled to the hydrotreating zone together with a fresh supply of hydrogen in an amount sufficient to maintain the hydrotreating zone pressure. A spent aqueous neutralizing solution is recovered from the high pressure separator. A hydrotreated hydrocarbonaceous stream containing 50 weight parts per million (PPM) of hydrogenatable hydrocarbonaceous compounds is also recovered from the high pressure separator and introduced into an adsorption zone loaded with activated carbon particles. The operating conditions of the adsorption zone include a pressure of about 25 psig (172 k Pa gauge), a temperature of 80° F. (27° C.) and a liquid hourly space velocity of about 10. The hydrocarbonaceous effluent is removed from the adsorption zone and is found to have less than 1 PPM of hydrogenatable hydrocarbonaceous compounds. A spent adsorption zone which becomes unable to produce a hydrocarbonaceous effluent free from hydrogenatable hydrocarbonaceous compounds is isolated and the spent adsorption zone is regenerated by contacting the activated charcoal containing hydrogenatable hydrocarbonaceous compounds with an elution solvent comprising hot water at conditions which include a temperature of 200° F. (93° C.), and a pressure of about 25 psig (172 k Pa gauge) for a time sufficient to elute or remove substantially all of the transient hydrogenatable hydrocarbonaceous compounds from the activated carbon adsorbent. The resulting elution solvent comprising hot water and entrained hydrogenatable hydrocarbonaceous compounds removed from the adsorbent is then introduced into the hydrotreating reaction zone. The regenerated adsorption zone may then be placed on line in order to remove additional hydrogenatable hydrocarbonaceous compounds from a hydrotreated hydrocarbonaceous stream.

The foregoing description, drawing and illustrative embodiment clearly illustrate the advantages encompassed by the process of the present invention and the benefits to be afforded with the use thereof.

We claim as our invention:

1. A process for hydrotreating a hydrocarbonaceous charge stock comprising hydrocarbonaceous compounds selected from the group consisting of halogenated hydrocarbons and organometallic compounds which process comprises the steps of:

(a) contacting said hydrocarbonaceous charge stock in the presence of hydrogen with a hydrogenation catalyst in a hydrotreating reaction zone to thereby remove at least a portion of the halogen or metal entity from said hydrocarbonaceous charge stock;

(b) contacting the resulting hydrotreating reaction zone effluent with an aqueous scrubbing solution;

(c) introducing a resulting admixture of said reaction zone effluent and said aqueous scrubbing solution into a separation zone to provide a hydrotreated hydrocarbonaceous stream having trace quantities of hydrocarbonaceous compounds selected from the group consisting of halogenated hydrocarbons and organometallic compounds and a spent aqueous stream; and (d) contacting said hydrotreated hydrocarbonaceous stream with an adsorbent to remove at least a portion of said trace quantities of hydrocarbonaceous compounds from said hydrotreated hydrocarbonaceous stream.

2. The process of claim 1 wherein said hydrotreating reaction zone is operated at conditions which include a pressure from about 100 psig (2068 k Pa gauge) to about 2000 psig (13790 k Pa gauge), a maximum catalyst temperature from about 350° F. (204° C.) to about 850° F. (454° C.) and a hydrogen circulation rate from about 200 SCFB (35.6 std $m^3/m^3$) to about 10,000 SCFB (1778 std $m^3/m^3$).

3. The process of claim 1 wherein said hydrogenation catalyst comprises a refractory inorganic oxide and at least one metallic compound having a hydrogenation activity.

4. The process of claim 3 wherein said metallic compound is selected form the metals of Group VI-B and VIII of the Periodic Table.

5. The process of claim 1 wherein said aqueous scrubbing solution comprises an alkaline compound.

6. The process of claim 5 wherein said alkaline compound is sodium hydroxide, potassium hydroxide or calcium hydroxide.

7. The process of claim 1 wherein said adsorbent is silica gel, activated carbon, activated alumina, silica-alumina gel, clay, molecular sieves or admixtures thereof.

8. A process for hydrotreating a hydrocarbonaceous charge stock comprising hydrocarbonaceous compounds selected from the group consisting of halogenated hydrocarbons and organometallic compounds which process comprises the steps of:

(a) contacting said hydrocarbonaceous charge stock in the presence of hydrogen with a hydrogenation catalyst in a hydrotreating reaction zone to thereby remove at least a portion of the halogen or metal entity from said hydrocarbonaceous charge stock;

(b) contacting the resulting reaction zone effluent with an aqueous scrubbing solution;

(c) introducing a resulting admixture of said reaction zone effluent and said aqueous scrubbing solution into a separation zone to provide a hydrotreated hydrocarbonaceous stream having trace quantities of hydrocarbonaceous compounds selected from the group consisting of halogenated hydrocarbons and organometallic compounds and a spent aqueous stream;

(d) contacting said hydrotreated hydrocarbonaceous stream with an adsorbent to remove at least a portion of said trace quantities of hydrocarbonaceous compounds from said hydrotreated hydrocarbonaceous stream;

(e) removing said hydrocarbonaceous compounds selected from the group consisting of halogenated hydrocarbons and organometallic compounds from spent adsorbent with an elution solvent and thereby regenerating said adsorbent; and (f) passing said elution solvent containing hydrocarbonaceous compounds which were removed from said spent absorbent in step (e) into said hydrotreating reaction zone of step (a).

9. The process of claim 8 wherein said hydrotreating reaction zone is operated at conditions which include a pressure from about 100 psig (2068 k Pa gauge) to about 2000 psig (13790 k Pa gauge), a maximum catalyst temperature from about 350° F. (204° C.) to about 850° F. (454° C.) and a hydrogen circulation rate from about 200 SCFB (35.6 std $m^3/m_3$) to about 10,000 SCFB (1778 std $m^3/m^3$).

10. The process of claim 8 wherein said hydrogenation catalyst comprises a refractory inorganic oxide and at least one metallic compound having hydrogenation activity.

11. The process of claim 10 wherein said metallic compound is selected from the metals of Group VI-B and Group VIII of the Periodic Table.

12. The process of claim 8 wherein said aqueous scrubbing solution comprises an alkaline compound.

13. The process of claim 12 wherein said alkaline compound is sodium hydroxide, potassium hydroxide or calcium hydroxide.

14. The process of claim 8 wherein said adsorbent is silica gel, activated carbon, activated alumina, silica-alumina gel, clay, molecular sieves or admixtures thereof.

15. A process for regenerating a spent adsorbent which contains hydrocarbonaceous compounds selected from the group consisting of halogenated hydrocarbons and organometallic compounds which process comprises the steps of:

(a) removing said hydrocarbonaceous compounds from said spent adsorbent with an elution solvent and thereby regenerating said adsorbent; and (b) passing said elution solvent containing hydrocarbonaceous compounds which were removed from said spent adsorbent in step (a) into a hydrotreating reaction zone.

16. The process of claim 15 wherein said elution solvent is water or steam.

* * * * *